US008501671B2

(12) United States Patent
Hishinuma et al.

(10) Patent No.: US 8,501,671 B2
(45) Date of Patent: Aug. 6, 2013

(54) GREASE COMPOSITION AND PROCESS FOR PRODUCING THE SAME

(75) Inventors: Takeshi Hishinuma, Kitaibaraki (JP); Motoyuki Inai, Kitaibaraki (JP); Toshio Nitta, Kitaibaraki (JP)

(73) Assignee: NOK Klueber Co., Ltd., Tokyo (JP)

( * ) Notice: Subject to any disclaimer, the term of this patent is extended or adjusted under 35 U.S.C. 154(b) by 404 days.

(21) Appl. No.: 12/631,605

(22) Filed: Dec. 4, 2009

(65) Prior Publication Data

US 2010/0190668 A1 Jul. 29, 2010

(30) Foreign Application Priority Data

Jan. 29, 2009 (JP) ..... 2009-018437

(51) Int. Cl.
*C10M 169/02* (2006.01)
*C10M 107/38* (2006.01)

(52) U.S. Cl.
USPC ..... 508/182; 508/552; 508/582; 508/588

(58) Field of Classification Search
USPC ..... 508/182, 588
See application file for complete search history.

(56) References Cited

U.S. PATENT DOCUMENTS 5,948,737 A 9/1999 Srinivasan et al.

FOREIGN PATENT DOCUMENTS

JP 7-268370 A 10/1995
JP 200396480 A 4/2003
JP 200618293 A 7/2006

*Primary Examiner* — Ellen McAvoy
*Assistant Examiner* — Vishal Vasisth
(74) *Attorney, Agent, or Firm* — Woodcock Washburn, LLP

(57) ABSTRACT

A process for producing a grease composition which is capable of homogeneously and surely dispersing a non-fluorine-based base oil blended with a thickening agent and a fluorine-based base oil blended with a thickening agent. A mixture of a non-fluorine-based base oil blended with a first thickening agent and a fluorine-based base oil blended with a second thickening agent that are not mutually compatible is homogeneously treated at a shear rate of 150 $s^{-1}$ or higher to form a morphology structure in which one of the non-fluorine-based base oil and fluorine-based base oil is homogeneously dispersed in a particulate form having a mean particle diameter of not more than 25 μm in the other base oil.

6 Claims, 1 Drawing Sheet

| | Example 1 | Example 2 | Example 3 | Comparative Example 1 |
|---|---|---|---|---|
| Percentage By Volume of Grease (A:B) | 75:25 | ← | ← | ← |
| Shear Rate in Homogeneous Treatment ($S^{-1}$) | 25000 | 1500 | 150 | 50 |
| Particle Diameter (μM) | ≤ 5 | ≤ 10 | ≤ 20 | ≥ 30 |
| Oil Separation Degree (WT.%) | 0.4 | 0.7 | 0.8 | 1.5 |
| Friction Coefficient | 0.04 | 0.04 | 0.04 | 0.06 |
| Wear Track Diameter (MM) | 0.4 | 0.4 | 0.5 | 0.7 |
| Bleeding (MM) | 15.4 | 15.9 | 17.2 | 18.1 |

| | Example 4 | Example 5 | Comparative Example2 |
|---|---|---|---|
| Percentage By Volume of Grease (A:B) | 25:75 | ← | ← |
| Shear Rate in Homogeneous Treatment ($S^{-1}$) | 25000 | 1500 | 50 |
| Particle Diameter (μM) | ≤ 5 | ≤ 10 | ≥ 25 |
| Oil Separation Degree (WT.%) | 0.8 | 0.9 | 2.0 |
| Friction Coefficient | 0.04 | 0.05 | 0.09 |
| Wear Track Diameter (MM) | 0.5 | 0.6 | 0.8 |
| Bleeding (MM) | 16.5 | 16.4 | 16.9 |

| | Example 1 | Example 2 | Example 3 | Comparative Example 1 |
|---|---|---|---|---|
| Percentage By Volume of Grease (A:B) | 75:25 | ← | ← | ← |
| Shear Rate in Homogeneous Treatment ($S^{-1}$) | 25000 | 1500 | 150 | 50 |
| Particle Diameter (μM) | ≤ 5 | ≤ 10 | ≤ 20 | ≥ 30 |
| Oil Separation Degree (WT.%) | 0.4 | 0.7 | 0.8 | 1.5 |
| Friction Coefficient | 0.04 | 0.04 | 0.04 | 0.06 |
| Wear Track Diameter (MM) | 0.4 | 0.4 | 0.5 | 0.7 |
| Bleeding (MM) | 15.4 | 15.9 | 17.2 | 18.1 |

FIGURE 1A.

| | Example 4 | Example 5 | Comparative Example2 |
|---|---|---|---|
| Percentage By Volume of Grease (A:B) | 25:75 | ← | ← |
| Shear Rate in Homogeneous Treatment ($S^{-1}$) | 25000 | 1500 | 50 |
| Particle Diameter (μM) | ≤ 5 | ≤ 10 | ≥ 25 |
| Oil Separation Degree (WT.%) | 0.8 | 0.9 | 2.0 |
| Friction Coefficient | 0.04 | 0.05 | 0.09 |
| Wear Track Diameter (MM) | 0.5 | 0.6 | 0.8 |
| Bleeding (MM) | 16.5 | 16.4 | 16.9 |

FIGURE 1B.

GREASE COMPOSITION AND PROCESS FOR PRODUCING THE SAME

CROSS-REFERENCE TO RELATED APPLICATIONS

This application claims priority to Japanese Patent Application No. 2009-018437 filed Jan. 29, 2009 and is hereby incorporated by reference in its entirety.

TECHNICAL FIELD

The present invention relates to a grease composition and a process for producing the same, particularly to a process for producing a grease composition, in which two kinds of base oils blended with thickening agents, which are not mutually compatible are homogeneously dispersed, and to a grease composition produced by the process.

BACKGROUND

Conventional fluorine-based greases have been composed by adding small amounts of various additives, such as rust preventing agents, to thickening agents, such as a homopolymer (PTFE) of tetrafluoroethylene (TFE), a copolymer (FEP) of TFE and hexafluoropropylene, a copolymer (PFA) of TFE and perfluoroalkyl vinyl ether, and a copolymer (ETFE) of TFE and ethylene, with perfluoropolyether as a base oil, and have been used under severe conditions that require low-temperature properties, high-temperature durability, oxidation stability, chemical resistance, and the like.

However, since both base oils and thickening agents are fluorine-containing polymers, the conventional fluorine-based greases are expensive and problems such as poor fit with resins, metals, rubbers and the like, which are the materials to be lubricated, the fact that the oil film necessary for lubrication cannot be formed under conditions such as high load, causing abrasion and poor torque transmission efficiency due to a high friction coefficient, as well as poor rust prevention and corrosion resistance arise.

In order to solve such problems, it has been proposed to use a mixture obtained by mixing non-fluorine-based grease with fluorine-based grease. For example, in Japanese Patent Application Disclosure No. 7-268370, there is disclosed a grease containing hydrogenated mineral oil and/or synthetic lubricating oil, a fluoropolyether oil and an organic or inorganic thickening agent, wherein the weight ratio of lubricating oil+fluoropolyether oil:thickening agent is 97:3 to 80:20 and the weight ratio of lubricating oil:fluoropolyether oil is 95:5 to 60:40.

It has been considered that a homogenizer such as a Manto Galvin type homogenizer or a three-cylinder homogenizer (the three-cylinder homogenizer can be thought of as being a three-division cylinder block type homogenizer) is used for the blending for preparing greases using such base oil mixtures and the number of homogenizer treatments is preferably two to three times the number of treatments performed for an ordinary non-fluorine-based grease, in order to obtain superior homogeneity. However, it is difficult to obtain a homogeneous grease mixture by the blending treatment with a homogenizer even if the number of treatments is increased.

Although in Japanese Patent Application Disclosure No. 2003-96480 and 2006-182923 which concern applications by the applicant, there are disclosed a method of manufacturing a lubricating grease composition comprising a non-fluorine-based grease and a fluorine-based grease by thoroughly kneading them with a three-roll or high-pressure homogenizer, no mention is made of obtaining a homogeneous grease mixture.

Although a grease mixture is not only less expensive than a single fluorine-based grease, but also superior in abrasion resistance to an opposite material, there is no mention of a homogeneous dispersion of not mutually compatible base oils, and the base oils of a grease may be separated depending on the dispersion degree.

SUMMARY

The present invention provides a process for producing a grease composition, which is capable of homogeneously and surely dispersing a non-fluorine-based base oil blended with a thickening agent and a fluorine-based base oil blended with a thickening agent, and a grease composition produced by the process.

In a first aspect of the present invention, there is provided a process for producing a grease composition characterized by homogeneously treating a mixture of a non-fluorine-based base oil blended with a first thickening agent and a fluorine-based base oil blended with a second thickening agent that are not mutually compatible at a shear rate of 150 $s^{-1}$ or higher to form a morphology structure in which one of the non-fluorine-based base oil and fluorine-based base oil is homogeneously dispersed in a particulate form having a mean particle diameter of not more than 25 μm in the other base oil.

Preferably, a mixture composed of 5 to 95% by volume of a non-fluorine-based base oil blended with a first thickening agent and 95 to 5% by volume of a fluorine-based base oil blended with a second thickening agent, the total amount of the first and second thickening agents accounting for 10 to 50% by volume of the composition, can be submitted to the homogeneous treatment.

Preferably, the mixture can be homogeneously treated at a shear rate of 1500 $s^{-1}$ or higher to form a morphology structure, in which one of the non-fluorine-based base oil and fluorine-based base oil is homogeneously dispersed in a particulate form having a mean particle diameter of not more than 10 μm in the other base oil.

Preferably, the mixture can be homogeneously treated at a shear rate of 25000 $s^{-1}$ or higher to form a morphology structure, in which one of the non-fluorine-based base oil and fluorine-based base oil is homogeneously dispersed in a particulate form having a mean particle diameter of not more than 5 μm in the other base oil.

In a second aspect of the present invention, there is provided a grease composition characterized by being produced by the production process according to the first aspect of the present invention.

According to the present invention, a mixture of a non-fluorine-based base oil blended with a first thickening agent and a fluorine-based base oil blended with a second thickening agent that are not mutually compatible is homogeneously treated at a shear rate of 150 $s^{-1}$ or higher to form a morphology structure in which one of the non-fluorine-based base oil and fluorine-based base oil is homogeneously dispersed in a particulate form having a mean particle diameter of not more than 25 μm in the other base oil. This makes it possible to obtain the effects of (1) reduced oil separation (oil separation degree) at high temperatures and (2) a low and stable friction coefficient. As a result, practical effects, such as (a) no reduction of base oil even in the case of use at high temperatures for a long time, (b) improvement in the reliability of devices due to a low and stable friction coefficient and (c) extension of the life spans of devices due to reduced abrasion, can be surely achieved.

Further features of the present invention will become apparent from the following detailed description of exemplary embodiments with reference to the attached drawings.

BRIEF DESCRIPTION OF THE DRAWINGS

FIG. 1 is a diagram showing examples and comparative examples of grease compositions according to the embodiments of the present invention: FIGS. 1(*a*) and 1(*b*) show the results of the measurement.

DETAILED DESCRIPTION OF ILLUSTRATIVE EMBODIMENTS

As a result of extensive research in order to achieve the above-mentioned object, the present inventors found that a morphology structure in which one of the base oils is homogeneously dispersed in a particulate form with a mean particle diameter of not more than 25 μm in the other base oil can be formed by homogeneously treating a mixture of a non-fluorine-based base oil blended with a thickening agent and a fluorine-based base oil blended with a thickening agent that are not mutually compatible at a shear rate of 150 $s^{-1}$ or higher and that a stable grease composition with reduced oil separation (oil separation degree) at high temperatures and a low friction coefficient can be produced thereby. It was also found that homogeneous treatments of said mixture at shear rates of 150 $s^{-1}$ or higher, preferably 1500 $s^{-1}$ or higher and more preferably 25000 $s^{-1}$ or higher, result in mean dispersion particle diameters of not more than 20 μm, 10 μm and 5 μm, respectively, and thus the oil separation degree of the grease can be further decreased and the grease can be further stabilized.

The present invention was accomplished based on the above-mentioned research results.

Embodiments of the present invention will hereinafter be described in detail with reference to the drawings.

A grease composition according to an embodiment of the present invention comprises a mixture of a non-fluorine-based base oil blended with a thickening agent and a fluorine-based base oil blended with a thickening agent that are not mutually compatible, wherein a morphology structure is formed, in which one of the base oils has a particulate form with a mean particle diameter of not more than 25 μm and is homogeneously dispersed in the other base oil. Preferably, the grease composition comprises a mixture of 5 to 95% by volume of a non-fluorine-based base oil blended with a thickening agent and 95 to 5% by volume of a fluorine-based base oil blended with a thickening agent.

The fact that the non-fluorine-based base oil blended with a thickening agent and the fluorine-based base oil blended with a thickening agent are not mutually compatible means that a homogeneous grease composition cannot be formed by simply mixing said base oils.

The non-fluorine-based base oil blended with a thickening agent is composed as a base grease and comprises a non-fluorine-based base oil and a thickening agent to be blended to such a type of base oil.

As a non-fluorine-based base oil, at least one of the following is used: synthetic hydrocarbon oils such as poly-α-olefin, ethylene-α-olefin oligomer, polybutene or hydrides thereof, alkylbenzene, alkylnaphthalene and the like; ether-based synthetic oils such as polyalkylene glycol, polyphenyl ether, alkyl-substituted diphenyl ether and the like; ester-based synthetic oils such as trimellitic acid ester, pyromellitic acid ester, neopentyl glycol ester, trimethylolpropane ester, pentaerythritol ester, dipentaerythritol ester and the like; synthetic oils such as polyol ester, aromatic polyvalent carboxylic acid ester, aliphatic dibasic acid ester, phosphoric acid ester, phosphorous ester, carbonic acid ester and the like; and paraffinic mineral oils, naphthenic mineral oils or mineral oils prepared by purifying the same. Base oils with a kinematic viscosity at 40° C. (based on JIS K2283 corresponding to ASTM D445-86) of about 2 to 1000 $mm^2$/second, preferably about 10 to 500 $mm^2$/second, are generally used.

Thickening agents to be blended to said non-fluorine-based base oils include metallic soaps or metallic complex soaps such as lithium soap, sodium soap, potassium soap, calcium soap, aluminum soap and barium soap; urea-based compounds such as aliphatic, alicyclic or aromatic diurea, triurea, tetraurea and polyurea; and inorganic thickening agents such as bentonite and silica, wherein at least one of these thickening agents is used in a percentage of about 5 to 50% by volume, preferably about 7 to 40% by volume, of the base grease.

The fluorine-based base oil blended with a thickening agent is composed as a base grease and comprises a fluorine-based base oil and a thickening agent to be blended in such a type of base oil.

Fluorine-based base oils which have a kinematic viscosity at 40° C. (based on JIS K2283) of about 10 to 1500 $mm^2$/second, preferably about 20 to 500 $mm^2$/second, are generally used. More specifically, fluorine-based base oils represented by the general formula: $RfO(CF_2O)_x(C_2F_4O)_y(C_3F_6O)_zRf$ are used. Specifically, fluorine-based base oils represented by, for example, the following general formulas (1) to (4) are used, and in addition, a fluorine-based base oil represented by the general formula (5) is used. In the formula, Rf represents $C_1$-$C_5$, preferably $C_1$-$C_3$, perfluoro lower alkyl group, such as perfluoromethyl group, perfluoroethyl group and perfluoropropyl group.

$$RfO(CF_2CF_2O)_m(CF_2O)_nRf \quad (1)$$

wherein m+n=3 to 200; m:n=10 to 90:90 to 10; and $CF_2CF_2O$ and $CF_2O$ groups bind randomly in the main chain. These oils can be obtained by a complete fluorination of a precursor generated by photooxidation polymerization of tetrafluoroethylene.

$$RfO[(CF(CF_3)CF_2O)]_m(CF_2O)_nRf \quad (2)$$

wherein m+n=3 to 200; m:n=10 to 90:90 to 10; and $CF(CF_3O)CF_2O$ and $CF_2O$ groups bind randomly in the main chain. These oils can be obtained by a complete fluorination of a precursor generated by photooxidation polymerization of hexafluoropropylene.

$$RfO[(CF(CF_3)CF_2O)]_p(CF_2CF_2O)_q(CF_2O)_rRf \quad (3)$$

wherein p+q+r=3 to 200; q and r may be 0; and $CF(CF_3)CF_2O$, $CF_2CF_2O$ and $CF_2O$ groups bind randomly in the main chain. These oils can be obtained by a complete fluorination of a precursor generated by photooxidation polymerization of hexafluoropropylene and tetrafluoroethylene.

$$RfO[(CF(CF_3)CF_2O)]_s(CF_2CF_2O)_tRf \quad (4)$$

wherein s+t=2 to 200; t may be 0; t/s=0 to 2; and $CF(CF_3)CF_2O$ and $CF_2O$ groups bind randomly in the main chain. These oils can be obtained by a complete fluorination of a precursor generated by photooxidation polymerization of hexafluoropropylene and tetrafluoroethylene or by anion-polymerization of hexafluoropropylene oxide or tetrafluoroethylene oxide in the presence of a cesium fluoride catalyst and treating the resultant acid fluoride compound having a terminal —$CF(CF_3)COF$ group with fluorine gases.

$$F(CF_2CF_2CF_2O)_{2\text{-}100}C_2F_5 \quad (5)$$

can be obtained by anion-polymerizing 2,2,3,3-tetrafluorooxetane in the presence of a cesium fluoride catalyst and treating the resultant fluorine-containing polyether ($CH_2CF_2CF_2O$) under ultraviolet irradiation at about 160 to 300° C. with fluorine gas.

Generally, a fluorine resin is used as the thickening agent to be blended to these fluorine-based base oils and a fluorine resin is preferably used so that polytetrafluoroethylene (PTFE) resin powder, tetrafluoroethylene-hexafluoropropene copolymer (FEP) powder, perfluoroalkylene resin powder and the like make up about 5 to 50% by volume, preferably about 10 to 40% by volume, of a base grease.

The polytetrafluoroethylene to be used is produced by producing polytetrafluoroethylene by a procedure such as emulsion polymerization, suspension polymerization or solution polymerization of tetrafluoroethylene, and treating if by a procedure such as thermal decomposition, electron beam irradiation decomposition or physical pulverization in order to obtain a number-average molecular weight of about 1000 to 1000000. The copolymerization reaction and low molecular weight treatment of tetrafluoroethylene and hexafluoropropene are also carried out as in the case of polytetrafluoroethylene, and tetrafluoroethylene-hexafluoropropene having a number-average molecular weight of about 1000 to 6000000 is used. In addition, the molecular weight may also be controlled by using a chain transfer agent in the copolymerization reaction.

Thickening agents with a mean particle diameter of less than 25 μm, preferably 0.1 to 20 μm, are used as the thickening agents to be blended to the non-fluorine-based base oil and the fluorine-based base oil, respectively, to form a grease so that the mean particle diameter (average of values measured by observation by optical microscope) of the particulate base oil to be used as a dispersed phase would be preferably less than 25 μm and that a morphology structure mentioned below can be formed. When the mean particle diameter of one of the base oils blended with a thickening agent to be used as a dispersed phase is more than 25 μm, the base oil particles are damaged in the state of normal preservation of a grease composition, a homogeneous dispersion state of the base oil particles cannot be maintained, and neither the heat resistance of the non-fluorine-based grease nor the lubricity of the fluorine-based grease can be improved. In addition, when the oils are sheared, the form of the grease cannot be maintained, and, furthermore, grease cannot be supplied to the contact surface and the friction coefficient and abrasion will be increased.

Thickening agents are blended in such a manner that the proportion of the total amount of the thickening agents is 10 to 50% by volume of the composition. When the total rate of the thickening agents is less than 10% by volume, grease becomes softened regardless of whether or not a morphology structure exists and leaks out from a device, making its practical use impossible. On the other hand, when the total rate of the thickening agents is more than 50% by volume, grease becomes excessively hardened and rotation, for example, on a bearing, becomes impossible making its use impossible. In addition, it is necessary to blend a thickening agent suitable for each of the non-fluorine-based base oil and the fluorine-based base oil. Homogeneous dispersion cannot be obtained when blending only either one of the thickening agents and results in the separation of either of the base oils with the passage of time or rapid softening of the grease when the grease is sheared, making the retention of the form of the grease impossible. Abrasion resistance deteriorates when the amount of the fluorine-based base oil blended with a thickening agent is less than 5% by volume.

If necessary, additives that are conventionally used in lubricants, such as antioxidants, rust preventing agents, corrosion inhibitors, extreme pressure agents, oily agents and solid lubricants, may be blended to the composition. Antioxidants include, for example, phenolic antioxidants such as 2,6-ditertiary butyl-4-methylphenol and 4,4'-methylenebis (2,6-ditertiary butylphenol); amine-based antioxidants such as alkyl diphenylamines having $C_4$-$C_{20}$ alkyl group, triphenylamines, phenyl-α-naphthylamine, alkylated phenyl-α-naphthylamine, phenothiazines and alkylated phenothiazines; phosphoric acid-based antioxidants; sulfur-based antioxidants and the like.

Rust preventing agents include, for example, aliphatic acids, aliphatic acid metal salts, aliphatic amines, alkyl sulfonic acid metal salts, alkyl sulfonic acid amine salts, paraffin oxides, polyoxyethylene alkyl ethers. Corrosion inhibitors include, for example, benzotriazole, benzimidazole and thiadiazole.

Extreme pressure agents include, for example, phosphorus compounds such as phosphoric acid ester, phosphorous acid ester and phosphoric acid ester amine salts; sulfur-based compounds such as sulfides and disulfides; sulfur-based compound metal salts such as dialkyldithiophosphate metal salt and dialkyldithiocarbamate metal salt; and chlorine-based compounds such as chlorinated paraffin and chlorinated diphenyl.

Oily agents include, for example, aliphatic acids or esters thereof, higher alcohols, polyhydric alcohols or esters thereof, aliphatic esters, aliphatic amines, aliphatic acid monoglycerides, montan waxes, and amidic waxes. Other solid lubricants include, for example, molybdenum disulfide, graphite, boron nitride, silane nitride and melamine cyanurate. These other solid lubricants also have an average primary particle diameter of 25 μm or smaller, preferably 0.1 to 20 μm.

Processes for producing a grease composition according to the present invention include the following processes.

(1) A thickening agent based on, for example, soap or urea, is blended to a non-fluorine-based base oil and the mixture is kneaded by a three-roll mill or high-pressure homogenizer, preferably treated twice with a three-roll mill, to produce a non-fluorine-based grease. Furthermore, the fluorine-based base oil is mixed with the fluorine resin in a mixing furnace, the mixture is then kneaded by a three-roll mill or high-pressure homogenizer, preferably treated twice with a three-roll mill, to produce a fluorine-based grease. These two greases are mixed in a mixing furnace and the mixture is kneaded two or more times by a three-roll mill to prepare a grease composition. In said process, the shear rate is set at a value of 150 $s^{-1}$ or higher so that the necessary dispersion particle diameter can be obtained.

(2) A fluorine-based base oil and a fluorine resin are added to the non-fluorine-based grease produced as described above, the mixture is mixed in a mixing furnace and then kneaded two or more times by a three-roll mill at a roll clamping pressure of, for example, 10 $kgf/cm^2$=0.98 MPa to prepare a grease composition. In said process, the shear rate is set at a value of 150 $s^{-1}$ or higher so that the necessary dispersion particle diameter can be obtained.

Generally, a hydraulic mill is used as the three-roll mill to be used for kneading. An antioxidant or various other additives are added in the step of producing at least one of the non-fluorine-based base oil blended with a thickening agent and the fluorine-based base oil blended with a thickening agent or in the step of mixing them in a mixing furnace.

A grease composition prepared in such a manner comprises a mixture of a non-fluorine-based base oil blended with a thickening agent and a fluorine-based base oil blended with a thickening agent that are not mutually compatible, wherein one of the base oils blended with a thickening agent forms a morphology structure and is homogeneously dispersed in a particulate form in the other base oil blended with a thickening agent.

Although in a broad sense, a morphology structure encompasses a state of aggregation of molecules in a polymer alloy such as polymer blends and block copolymers in amorphous polymers it refers, in the present invention, to a structure, in which one of the base oils blended with a thickening agent forms a dispersed phase in a sea-island structure state and is homogeneously dispersed in a particulate form in the other base oil blended with a thickening agent forming a continuous phase.

One of the base oils blended with a thickening agent dispersed in a particulate form as a dispersed phase is dispersed in such a manner that the base oil blend in a particulate form having a mean particle diameter of not more than 25 μm, preferably not more than 10 μm, particularly preferably not more than 5 μm, is dispersed at a volume ratio of not less than 50%, preferably not less than 75%, particularly preferably not less than 90%, of the total dispersed phase particles. The volume ratio is calculated by measuring the total area of particles observed in a microphotograph, calculating an area ratio in an observed plane, and raising the area ratio to the power of 3/2 to convert the same into volume ratio.

The state in which such a base oil blended with a thickening agent in the form of a dispersed phase is homogeneously dispersed in a particulate form in a base oil blended with a thickening agent in the form of a continuous phase, i.e. the state in which the base oil is dispersed in the form of a morphology structure, varies according to the degree of the shear rate applied in the homogeneous treatment. For example, as shown in the examples described below, a shear rate of 150 $s^{-1}$ results in a mean dispersion particle diameter of not more than 20 μm, a shear rate of 1500 $s^{-1}$ results in a mean dispersion particle diameter of not more than 10 μm, and a shear rate of not more than 25000 $s^{-1}$ results in a mean dispersion particle diameter of not more than 5 μm. A smaller dispersed particle diameter results in a decreased oil separation degree of grease and more stabilization of the grease. Since an oil separation degree of 0.1 to 1.1% by weight is desirable in terms of practicality, a shear rate of not less than $150^{-1}$ and a mean particle diameter of not more than 25 μm are desirable. In contrast, since an excessively high shear rate results in a reduced amount of treated grease and corrupts production efficiency, the mean particle diameter can only be reduced to about 2 μm, wherefore the upper limit of the shear rate is about 60000 $s^{-1}$.

Here, the lubrication effect of the grease composition results from the oil bleeding from the grease composition, and the oil separation degree is used to assess an amount of the oil bleeding from a device (actual machine) to which grease is applied. A high value oil separation degree results in more than necessary oil bleeding, which shortens the life of a device (actual machine), whereas a low oil separation degree results in the deterioration of lubricity.

In one embodiment of the present invention, a bleeding test is conducted to assess the storage stability of the grease composition. The bleeding test is carried out by applying a grease composition roughly cylindrically to a ground glass and, after the lapse of a predetermined time span, assessing the grease composition based on the outer diameter of the oil that bled out from the cylindrical grease composition. A large outer diameter of oil results in a reduction in the original oil content, which shortens the life of the device after storage and, in addition, contaminates the vicinity of the part in which the oil is enclosed due to bleeding oil and compromises the appearance of the device. Specifically, it is to be considered that a smaller outer diameter of the oil bleeding from a grease composition results in superior storage stability of the grease composition.

As described above, according to an embodiment of the present invention, homogenization can be infallibly carried out to micro parts, and a grease with an extremely low oil separation degree when heated, higher stability and excellent heat resistance can be obtained by carrying out a homogeneous treatment of a non-fluorine-based grease and a fluorine-based grease that are not mutually compatible at a shear rate of not less than 150 $s^{-1}$ to form a morphology structure, in which one of the base oils is homogeneously dispersed in a particulate form having a mean particle diameter of not more than 25 μm in the other base oil. Therefore, since the extension of the life span of grease can be realized and excellent abrasion resistance to an opposite material and a low and stable friction coefficient can be obtained, energy saving and high accuracy of a device using this grease can be surely realized.

EXAMPLES

Examples of the present invention are described below.

Examples 1-5

Grease A (non-fluorine-based grease): Grease A was prepared by adding as a thickening agent an aliphatic diurea compound that makes up 10% by volume of the base grease to a trimellitic acid ester oil blended with 2% by weight of an amine-based antioxidant (kinematic viscosity of 100 $mm^2$/second at 40° C.), and the mixture was kneaded twice by a three-roll mill.

Grease B (fluorine-based grease): Grease B was produced by adding as a thickening agent a PTFE powder (mean particle diameter of 0.3 μm) that makes up 30% by volume of the base grease to a base oil having a molecular structure represented by RfO $(CF(CF_3)CF_2O)_m$Rf and a kinematic viscosity of 230 $mm^2$/second at 40° C., and the mixture was kneaded twice by a three-roll mill.

The above-mentioned non-fluorine-based grease (grease A) and fluorine-based grease (grease B) were mixed at a predetermined volume ratio, and the mixture was thoroughly stirred and mixed in a mixing furnace for 60 minutes at 30° C., followed by a homogeneous treatment at a predetermined shear rate.

For the resultant grease compositions, each of the following items was assessed or measured.

Particle diameter: The particle diameter of dispersed particles is observed with a microscope and the diameter of the particle in a photograph is defined as the particle diameter.

Heat resistance (oil separation degree): Based on JIS K2220.11 corresponding to ASTM D6184-98, an oil separation degree (% by weight) is measured after 24 hours at 180° C. (it is preferable for the value to be as low as possible).

Friction coefficient: A cylinder of 5 mm in diameter and 10 mm in height is put on a flat plate, and the flat plate is rotated under the conditions of room temperature, rotational speed of 1 m/s, load of 9.8 N, material SUS304 and a sliding form of the surface contact to measure the friction coefficient (it is preferable for the value to be as low as possible).

Friction characteristic (diameter of wear track): Based on ASTM D2266, a shell four-ball test is conducted to perform rotation under the conditions of a temperature of 75° C., rotational speed of 1,200 per minute, load of 392 N, and time span of 60 minutes to measure the diameter of a wear track (it is preferable for the value to be as low as possible).

Storage stability (bleeding test): A grease composition of 10 mm in outer diameter and 3 mm in height is cylindrically applied onto a ground glass and left still for 24 hours at 80° C. to assess the spread of oil bled from the cylindrical grease composition (the outer diameter of the bled oil is defined as a measured width A; see FIG. 1 (*b*)) (it is preferable for the measured width A to be as low as possible).

Comparative Examples

A non-fluorine-based grease (grease A) and a fluorine-based grease (grease B) were mixed at a predetermined volume ratio, and the mixture was thoroughly stirred and mixed in a mixing furnace for 60 minutes at 30° C. and then homogeneously treated at a shear rate of 50 $s^{-1}$. Each of the above-mentioned characteristics of the resultant grease compositions was assessed or measured in the same manner as in the examples.

The results obtained in each the above-mentioned examples and comparative examples are shown in FIGS. 1(*a*) and 1(*b*).

According to FIGS. 1 (*a*) and 1 (*b*), the homogeneous treatment of the non-fluorine-based grease (grease A) and the fluorine-based grease (grease B) at a shear rate of 150 $s^{-1}$ or higher was found to result in the formation of a morphology structure, in which one of the base oils is homogeneously dispersed in a particulate form having a mean particle diameter of not more than 20 μm in the other base oil. It was found that the outer diameter (measured width A) of the bled oil was 17.2 mm and exhibited good storage stability when the percentage by volume of the grease (grease A:grease B) was 75:25.

In the bleeding test of the above-mentioned examples, grease compositions are assessed based on the outer diameter of the oil that bled out from the grease composition, but bleeding tests are not limited to this. The grease composition can also be assessed by using a proportion $\alpha$=A/a, assuming the outer diameter of the grease composition at the time of the application to the ground glass as an initial value a and the outer value diameter of the oil that bled out after 25 hours of standing as A. In this case, a higher evaluation is given to the storage stability of the grease composition when the proportion $\alpha$ is low.

The grease compositions of the present invention having the above-mentioned characteristics are preferably used for the lubrication and protection of contact portions between individual sliding portions, such as rolling bearings, sliding bearings, gears, valves, cocks, oil seals and electric contacts, or in parts that require abrasion resistance and shear stability but do not require high heat resistance.

Specifically, the grease compositions of the present invention are preferably applied to various parts of various devices, machines and apparatuses described below.

Automobiles: rolling bearings and sliding bearings of electric radiator fan motors, fan couplings, electronically controlled EGRs, electronically controlled throttle valves, alternators, idler pulleys, electric brakes, hub units, water pumps, power windows, wipers and electric power steering systems that require heat resistance and shear stability; or electric contact parts of control switches for the gear part of automatic transmissions, lever control switches, and push switches that require heat resistance, shear stability, and abrasion resistance;

rubber sealing parts of the X-ring parts of viscous couplings and the O-rings of exhaust brakes that require heat resistance and shear stability; and rolling bearings, sliding bearings, gears, sliding parts, etc., of headlights, sheets, ABSs, door locks, door hinges, clutch boosters, two-divided flywheels, window regulators, ball joints, and clutch boosters.

Office appliances: rolling bearings and sliding bearings of the fuser rollers and fuser belts of copying machines, laser beam printers, and the like that require heat resistance and abrasion resistance; and the sliding or gear parts, etc. of resin films.

Resin manufacturing apparatuses: rolling bearings, sliding bearings, pins, oil seals, gears, etc. of film tenters, film laminaters, and banbury mixers that require heat resistance and load resistance.

Paper making devices: rolling bearings, sliding bearings, pins, oil seals, gears, etc. in corrugate machines that require heat resistance and abrasion resistance.

Timber processing devices: rolling bearings, sliding bearings, pins, oil seals, gears, etc. in punch presses (or continuous presses), and the like that require heat resistance and abrasion resistance.

Machines for food products: Rolling bearings, etc. of linear guides of bread-baking machines, ovens, and the like that require heat resistance and abrasion resistance.

Rolling bearings, sliding bearings, etc. in spindles, servomotors, and the like in machine tools that require a low friction coefficient.

Sliding parts, etc. of hinges of mobile phones that require shear stability and abrasion resistance.

Rolling bearings and gears in vacuum pumps of semiconductor manufacturing apparatuses, liquid crystal manufacturing apparatuses, electron microscopes, and the like, and rolling bearings, etc. in the breakers of electronically controlled devices.

Household electric/information appliances: rolling bearings, sliding bearings, oil seals, and the like in cooling fans for personal computers, vacuum cleaners, washing machines, and the like.

What is claimed:

1. A process for producing a grease composition, characterized by homogeneously treating a mixture of a non-fluorine-based base oil blended with a first thickening agent and a fluorine-based base oil, blended with a second thickening agent which are not mutually compatible at a shear rate of 150 $s^{-1}$ or higher to form a sea-island structure, in which one of the non-fluorine-based base oil and fluorine-based base oil is homogeneously dispersed in a particulate form having a mean particle diameter of not more than 25 μm in the other base oil, a mixture composed of a non-fluorine-based base oil blended with a first thickening agent making up 5% to 95% by volume of the composition and a fluorine-based base oil blended with a second thickening agent making up 95 to 5% volume of the composition, the total amount of the first and second thickening agents accounting for 10 to 50% by volume of the composition, being submitted to said homogeneous treatment, wherein the non-fluorine-based base oil is an ester-based synthetic oil;

wherein the first thickening agent is an urea-based compound;

wherein the fluorine-based base oil is selected from the group consisting of $RfO[(CF(CF_3)CF_2O)]_p(CF_2CF_2O)_q(CF_2O)_rRf$, wherein p+q+r =3 to 200, including a case wherein q and/or r is 0, and $CF(CF_3)CF_2O$ $CF_2CF_2O$ and $CF_2O$ groups are bound randomly in the main chain; $RfO[(CF(CF_3)CF_2O)]_s(CF_2CF_2O)_tRf$, wherein s+t =2 to 200, including a case where t is 0; t/s=0 to 2, and $CF(CF_3)CF_2O$ and $CF_2O$ groups are bound randomly in the main chain; and wherein the second thickening agent is a fluorine resin.

2. A process for producing a grease composition as claimed in claim 1, wherein said mixture is homogeneously treated at a shear rate of 1500 $s^{-1}$ or higher to form a sea-island structure, in which one of the non-fluorine-based base oil and fluorine-based base oil is homogeneously dispersed in a particulate form having a mean particle diameter of not more than 10 μm in the other base oil.

3. A process for producing a grease composition as claimed in claim 1, wherein said mixture is homogeneously treated at a shear rate of 25000 $s^{-1}$ or higher to form a sea-island structure, in which one of the non-fluorine-based base oil and fluorine-based base oil is homogeneously dispersed in a particulate form having a mean particle diameter of not more than 5 μm in the other base oil.

4. A grease composition produced by the process of claim 1.

5. A grease composition produced by the process of claim 2.

6. A grease composition produced by the process of claim 3.

* * * * *